US011377817B2

(12) United States Patent
See

(10) Patent No.: US 11,377,817 B2
(45) Date of Patent: Jul. 5, 2022

(54) DEVICE TO REMOVE GRAVEL FROM A ROOF

(71) Applicant: Philip See, Ilmey City, MI (US)

(72) Inventor: Philip See, Ilmey City, MI (US)

( * ) Notice: Subject to any disclaimer, the term of this patent is extended or adjusted under 35 U.S.C. 154(b) by 572 days.

(21) Appl. No.: 16/528,185

(22) Filed: Jul. 31, 2019

(65) Prior Publication Data

US 2020/0087886 A1 Mar. 19, 2020

Related U.S. Application Data

(60) Provisional application No. 62/733,173, filed on Sep. 19, 2018.

(51) Int. Cl.

| | |
|---|---|
| ***E02F 3/76*** | (2006.01) |
| ***E02F 3/815*** | (2006.01) |
| ***E04D 15/00*** | (2006.01) |

(52) U.S. Cl.

CPC ..... *E02F 3/7609* (2013.01); *E02F 3/815* (2013.01); *E04D 15/003* (2013.01)

(58) Field of Classification Search

CPC ..... E02F 3/7609; E02F 3/815; E02F 3/8155; E04D 15/003; E04D 15/02; E04G 23/006

USPC ..... 52/749.12; 81/45, 46; 30/170; 299/36.1, 37.1, 39.1

See application file for complete search history.

(56) References Cited

U.S. PATENT DOCUMENTS

| | | | | | |
|---|---|---|---|---|---|
| 1,415,949 | A * | 5/1922 | Perelman | E04D 15/003 | 15/93.1 |
| 2,172,785 | A * | 9/1939 | Beach | E01H 5/12 | 172/701.3 |
| 2,194,297 | A * | 3/1940 | Drumm | A01G 20/43 | 15/83 |
| 2,326,514 | A * | 8/1943 | Bard | E04D 15/003 | 173/24 |
| 2,519,138 | A * | 8/1950 | Katz | E04D 15/003 | 15/93.1 |
| 2,964,204 | A * | 12/1960 | Wilson | E01H 1/00 | 414/439 |
| 3,201,819 | A * | 8/1965 | Wilgus | A47L 11/4058 | 15/349 |
| 3,695,713 | A * | 10/1972 | Rothi | E04D 15/003 | 15/93.1 |
| 3,698,972 | A * | 10/1972 | Lenzner | E04D 15/07 | 428/491 |
| 4,053,183 | A * | 10/1977 | Probst | E04D 15/006 | 15/93.1 |
| 4,277,104 | A * | 7/1981 | Sanchez | E04D 15/003 | 15/93.1 |
| 4,699,430 | A * | 10/1987 | Nichols | E04D 15/003 | 15/93.1 |

(Continued)

*Primary Examiner* — James M Ference
(74) *Attorney, Agent, or Firm* — Linda L. Lewis

(57) ABSTRACT

The present invention is a device to remove gravel from a roof. The device is a blade assembly vertically mounted on a riding drive mechanism, such as a tractor, and the blade assembly has a smooth, horizontal blade, such as used for snow plowing, and mounted proximate and parallel to the smooth blade is a serrated blade having an up position and a down position. In the down position, the serrations extend to the roof to loosen and remove gravel. In the up position, the serrations are above the edge of the smooth blade which scrapes the loosened gravel. A downward force is provided to force the serrations between the gravel.

13 Claims, 8 Drawing Sheets

(56) References Cited

U.S. PATENT DOCUMENTS 4,709,479 A * 12/1987 Lavelette ..... E04D 15/003 15/93.1
4,858,503 A * 8/1989 Dike, Jr. ..... E04D 15/003 30/169
4,880,491 A * 11/1989 Jacobs ..... E04G 23/02 156/763
5,001,946 A * 3/1991 Shirlin ..... B25B 33/00 30/169
5,082,330 A * 1/1992 Holder ..... E04G 23/006 15/93.1
5,098,165 A * 3/1992 Jacobs ..... E04D 15/003 156/763
5,197,784 A * 3/1993 Holder ..... E04G 23/006 15/93.1
5,218,766 A * 6/1993 Himebaugh ..... E04D 15/003 30/170
5,244,333 A * 9/1993 Byrne ..... E01H 1/106 15/83
5,641,206 A * 6/1997 Craft ..... E04G 23/006 30/169
5,863,100 A * 1/1999 Martin ..... E04D 15/003 299/37.1
5,921,155 A * 7/1999 Faller ..... E04D 15/003 299/36.1
6,095,015 A * 8/2000 Phelan ..... E04D 15/003 81/46
6,116,117 A * 9/2000 Nicolosi ..... E04D 15/003 81/45
6,135,566 A * 10/2000 Anderson ..... E04G 23/006 299/37.1
6,273,513 B1 * 8/2001 Pope ..... E04G 23/006 15/93.1
6,467,377 B1 * 10/2002 Kersting ..... E04G 23/006 81/45
6,523,906 B1 * 2/2003 Holder ..... E01C 23/0885 15/93.1
6,711,971 B1 * 3/2004 Morin ..... E04D 15/003 81/46
7,127,968 B1 * 10/2006 Kriegar ..... E04D 15/003 81/46
7,216,567 B1 * 5/2007 Nelson ..... E04D 15/003 30/169
7,222,556 B2 * 5/2007 Tyler ..... E04D 15/003 30/169
7,299,719 B1 * 11/2007 Flakne ..... A01D 9/02 294/55.5
7,318,364 B1 * 1/2008 Nickolas ..... E04D 15/003 299/37.1
7,685,909 B1 * 3/2010 Jones ..... E04D 15/003 81/45
8,056,444 B1 * 11/2011 Van Straten ..... E04D 15/003 299/37.1
8,650,989 B1 * 2/2014 Bremer, Jr. ..... E04D 15/003 30/170
9,062,458 B2 * 6/2015 Berrian ..... E04D 15/003
9,945,128 B1 * 4/2018 Baird ..... E04D 15/07
2002/0109394 A1 * 8/2002 Phillips ..... E04G 23/006 299/36.1
2002/0124442 A1 * 9/2002 Waddington, Jr. ..... E02F 3/815 37/406
2004/0123554 A1 * 7/2004 Slack ..... E04D 15/003 52/749.12
2004/0187362 A1 * 9/2004 Harding ..... E02F 3/7609 37/403
2006/0117910 A1 * 6/2006 Gendron ..... E04D 15/003 81/45
2006/0156866 A1 * 7/2006 Ingell ..... E04D 15/003 81/45
2006/0179790 A1 * 8/2006 Bremer ..... E04D 15/003 52/749.12
2007/0000354 A1 * 1/2007 Tyler ..... E04D 15/003 81/45
2007/0245684 A1 * 10/2007 Bremer ..... E04D 15/003 52/749.12
2011/0030511 A1 * 2/2011 Schmidt ..... E04D 15/003 30/170
2015/0361638 A1 * 12/2015 Dorman ..... E02F 3/7618 172/701.1
2020/0087886 A1 * 3/2020 See ..... E02F 3/7609

* cited by examiner

DEVICE TO REMOVE GRAVEL FROM A ROOF

CROSS-REFERENCE TO RELATED APPLICATIONS

This application claims the benefit of provisional patent application 62/733,173 filed Sep. 19, 2018, which is hereby incorporated by reference.

STATEMENT REGARDING FEDERALLY SPONSORED RESEARCH

Not Applicable.

APPENDIX

Not Applicable.

BACKGROUND OF THE INVENTION

Field of the Invention

The present invention relates to removing gravel from a roof, and more particularly to a device using a drive mechanism and a serrated blade to remove gravel from a roof.

Related Art

The present invention relates to removing gravel from asphalt-coated flat roofs so that they may be repaired. Such roofs, mostly on commercial buildings, are built according to a standard procedure where layers of asphalt saturated felt are laid upon the roof surface to create an asphalt deck and cemented together with a coating of hot-mop asphalt or tar with the top layer being a comparatively thick coating of hot-mop asphalt or tar covered with a layer of small generally uniform rocks such as pea gravel or the like. The rocks forming the layer of gravel embed themselves into the asphalt to protect the roof covering, the asphalt, and the underlying felt sheets against physical damage and weather deterioration especially by sunlight.

A good average life for such a roof may be approximately ten years, at which time it must be repaired and rehabilitated. The common procedure for removing the rock is by sweeping the roof with heavy brooms. This is a very onerous, slow chore where the workmen are required to wear dust masks because of the large amounts of fine dust stirred up by the sweeping and dumping the gravel from the roof to a truck.

Alternatively, a rotary planer, such as a Garlock rotary planar, is used by workers who push to propel the device, and apply downward pressure to this heavy machine to slowly and laboriously remove gravel from a roof.

There has been a desire for a more effective and easier to use device to remove gravel from a roof. More specifically, it is desirable to have a riding device that removes gravel from a roof.

SUMMARY OF THE INVENTION

The present invention is a device to remove gravel adhering to a roof that has a vertically mounted blade assembly attached to a drive mechanism. The blade assembly includes a horizontal serrated blade and, optionally, a horizontal smooth blade. More specifically, the present invention is a riding drive mechanism, such as a tractor, having vertically mounted on the front of the tractor a blade assembly that includes a smooth blade with a horizontal edge, such as used for snow plowing, and, mounted proximate and parallel to the smooth blade, a serrated blade. Either the smooth blade or the serrated blade, or both blades have an up position and a down position. In a preferred embodiment, the blade assembly includes a mechanism to move the blades from the down position to the up position and back. In the down position, the blade or blades engage with the gravel to remove it from the roof. In one embodiment, in the down position, the serrations extend below the lower edge of the smooth blade and in the up position, the serrations are even with or above the edge of the smooth blade. Optionally, mounted on the either blade is at least one weight to provide a downward force.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
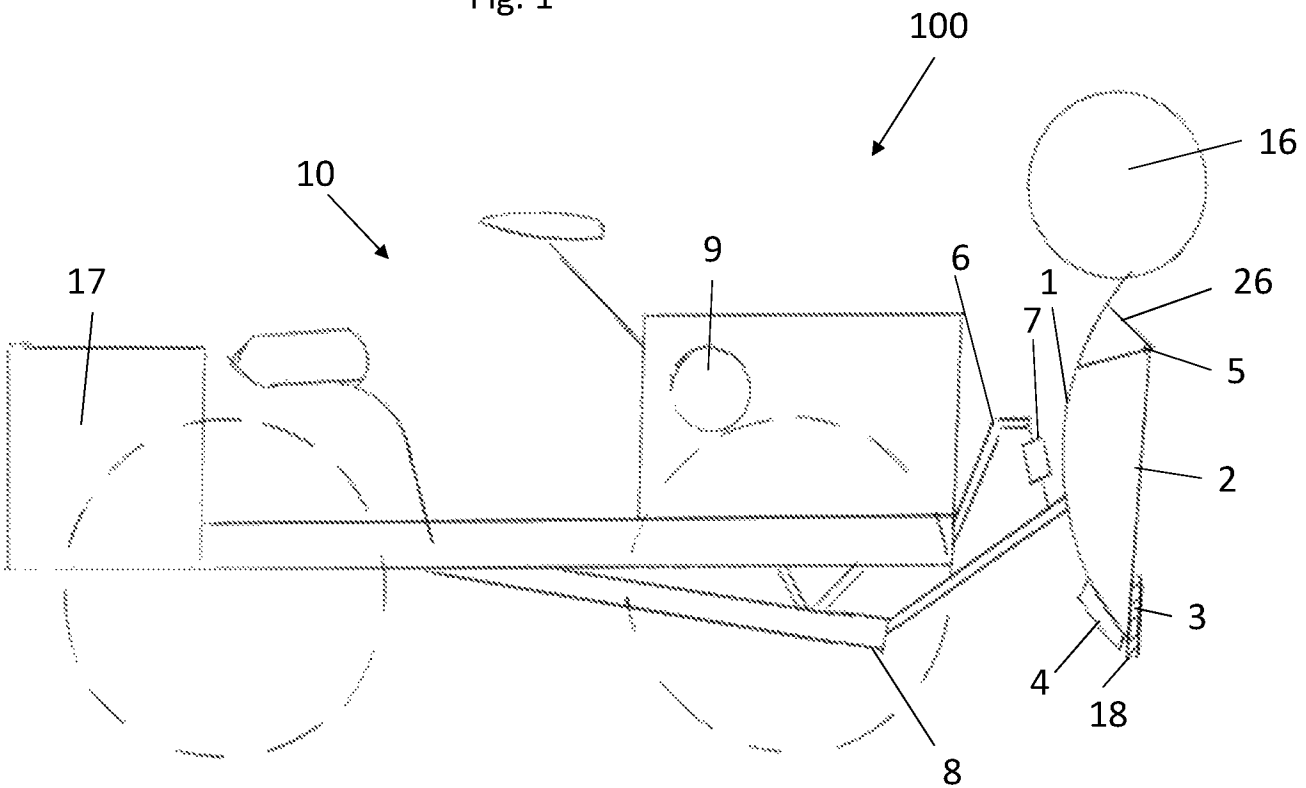
FIG. 1 is a side perspective of an embodiment of the device to remove gravel of this invention.

An embodiment of the claimed device is shown as 100 in FIG. 1. A driving mechanism, 10 is shown as a tractor. However, any drive mechanism, such as a truck, riding lawn mower, etc., could be used. A riding lawn mower is preferred, as it is small enough to be easily transported and raised onto a roof. Vertically mounted on the front end of the tractor is a smooth blade 1, which is typically used as snow plow blade. The smooth blade 1 has a lower horizontal edge 4. The smooth blade is mounted on the tractor has a smooth blade pivot point 8 which pivots the smooth blade to the up position for non-use and to the down position to contact the lower edge 4 with the asphalt deck and scrape the deck smooth and clear. The smooth blade is held by smooth brace arms 6 and moved by ball screw 7. Mounted in front of the smooth blade is the serrated blade 3 having an up position and a down position. In a preferred embodiment, the serrated blade is attached to the smooth blade by means of serrated brace arms 26 and pivot arms 2, which connect at a brace pivot point 5. In the embodiment of FIG. 1, the serrated blade 3 is moved manually to the up position and to the down position by pivoting at pivot point 5. In this embodiment, there are two pivot points; the smooth blade and the serrated blade each have separate pivot points. In the down position, the serrated blade 3 projects 18 below the smooth blade 4. This allows both the smooth blade and the serrated blades to be in the down position when the serrated blade is being used to remove gravel from a roof which further allows the serrated blade to be reinforced from behind by the smooth blade without interfering with the use of the serrations of the blade. Providing a downward force is weight 16 which is attached to the top of the smooth blade 1. This effectively provides a downward force for both the smooth blade and the serrated blade. In another embodiment, there is a weight on both blades, independently. Optionally, a weight storage box 17 can be attached to the tractor. An alternator 9 is part of the tractor 10.

The downward force can be provided by other mechanical sources such as hydraulic or pneumatic cylinders, compressed springs, screw-devices, etc.

Figure 2:
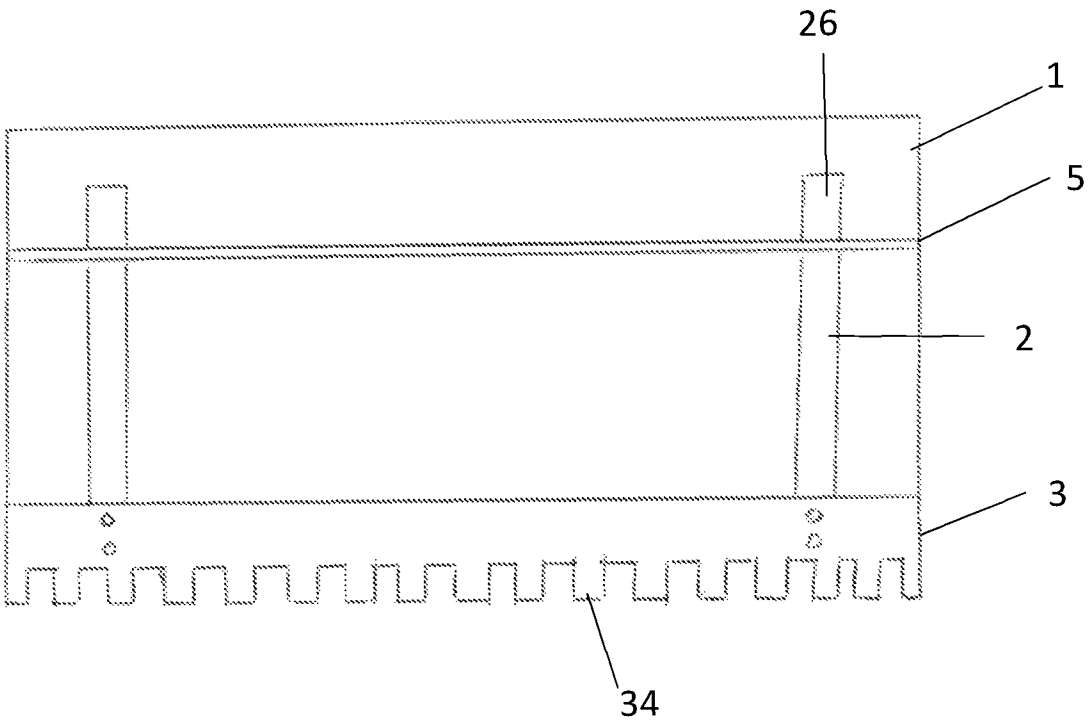
FIG. 2 is a front perspective of an embodiment of the blade assembly having a serrated blade mounted on a smooth blade of the present invention.

As shown in FIG. 2, the serrated blade 3 is attached to the smooth blade 1 by serrated brace arms 26 and more than one pivot arms 2 which have a brace pivot point 5.

Figure 3:
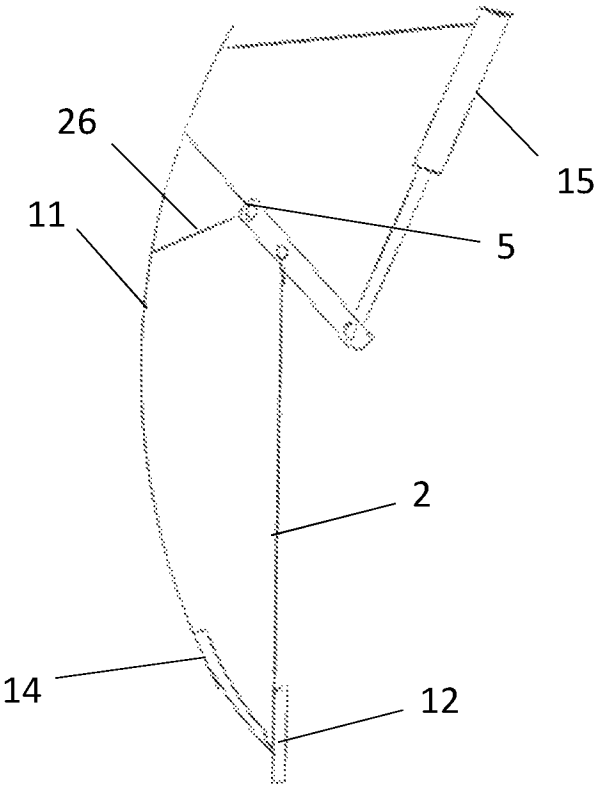
FIG. 3 is a side perspective of an embodiment of the blade assembly having the serrated blade mounted on the smooth blade, with the serrated blade in the down position.
Figure 4:
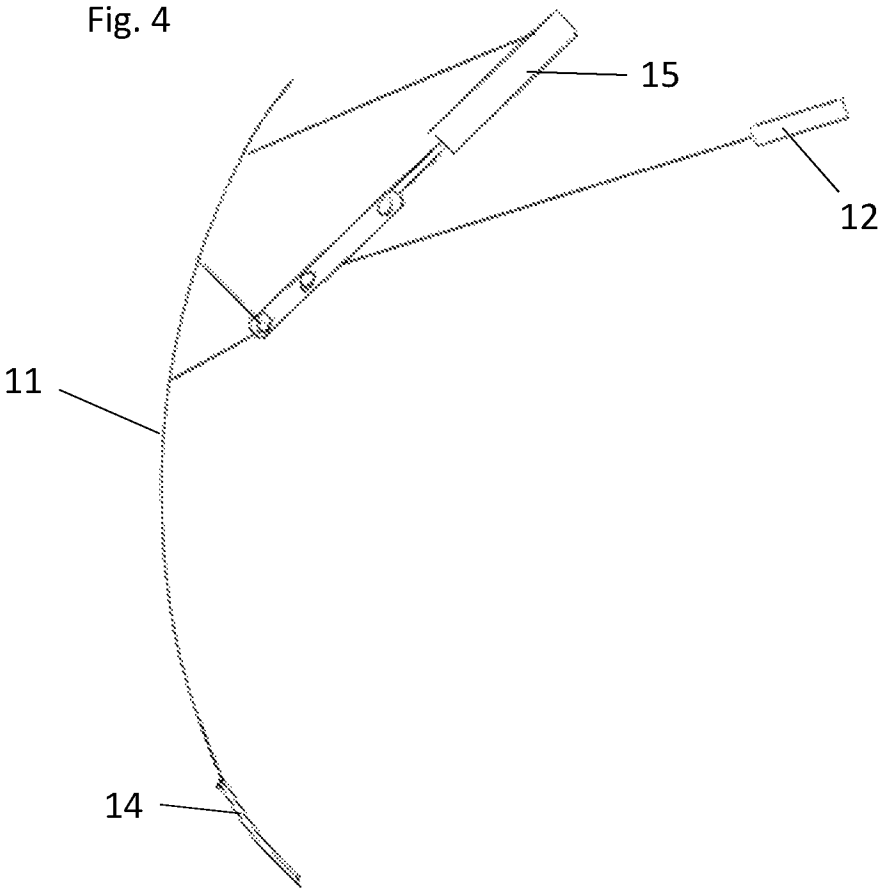
FIG. 4 is a side perspective of the serrated blade mounted on the smooth blade, with the serrated blade in the up position.

In FIG. 3, in a preferred embodiment, the blade assembly has a serrated blade 12 in the down position. It is moved from the down position to the up position by the ball screw 15, as shown in FIG. 4. This allows the operator of the device to raise and lower the serrated blade while seated and operating the riding device. Other driving devices, including hydraulic and pneumatic cylinders, cams, etc. can also be used to move the serrated blade 12 from the up position to the down position. Further, in FIGS. 3 and 4, the smooth blade 11 has a lower edge 14. The serrated blade 12 projects below the lower edge 14.

Figure 5:
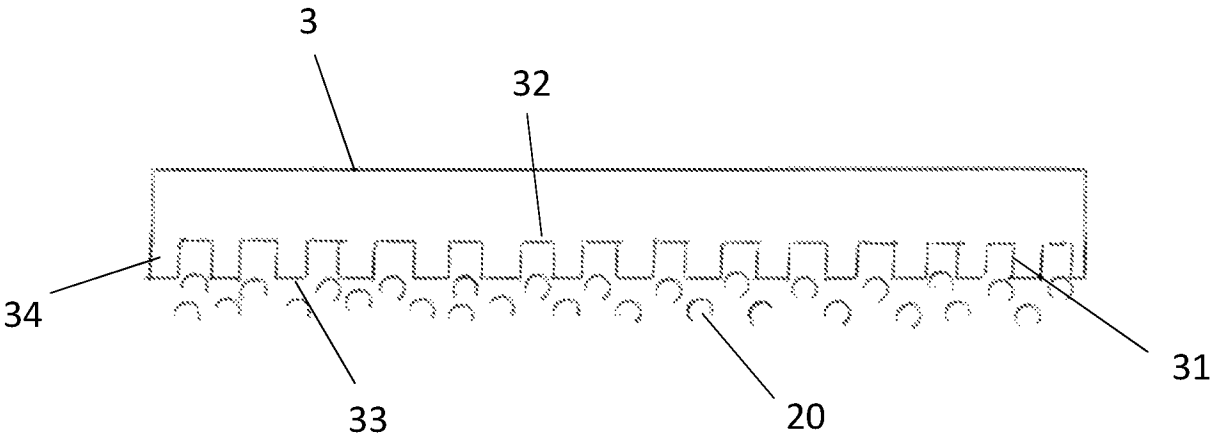
FIG. 5 is a front perspective of the serrated blade in the down position being used to loosen gravel.

As shown in FIG. 5, the serrated blade 3 has teeth 34 along its horizontal edge. The teeth have a depth 31 a width 33 and a gap width 32. Preferably, the teeth have a squared shape, with approximately straight dimensions. The flat leading edge is effective in scraping the gravel off the flat roof. The dimensions of the teeth are critical to the success of the teeth in removing gravel 20 from a roof. The preferred tooth width 33 is from about 1.0 to 1.5 inches. A more preferred is from about 1.0 to about 1.0624 inches. A preferred gap width 32 is from about 1.0 to 1.5 inches. A more preferred gap is from about 1.4 to 1.6 inches. A preferred depth 31 is from about 1.1 to 0.875 inches. A more preferred depth is about 1.0 to 0.90 inches. If the dimensions are greater or less than disclosed and claimed, the teeth do not penetrate between the gravel 20 and work to dislodge it.

Preferably, the serrated blade is made of a modified road grader blade. A typical blade has the dimensions of 6 inches by 1.5 feet by about ⅝ inches thick steel. A preferred steel is 6150 tooled steel from about ¼ to about 1 inch thick. The steel needs to have sufficient strength and inflexibility that, once modified with teeth, the teeth do not bend or break while in use. In a preferred embodiment, the blade is tapered from about 9/16 to 3/16 inch at the edge of the blade.

Figure 6:
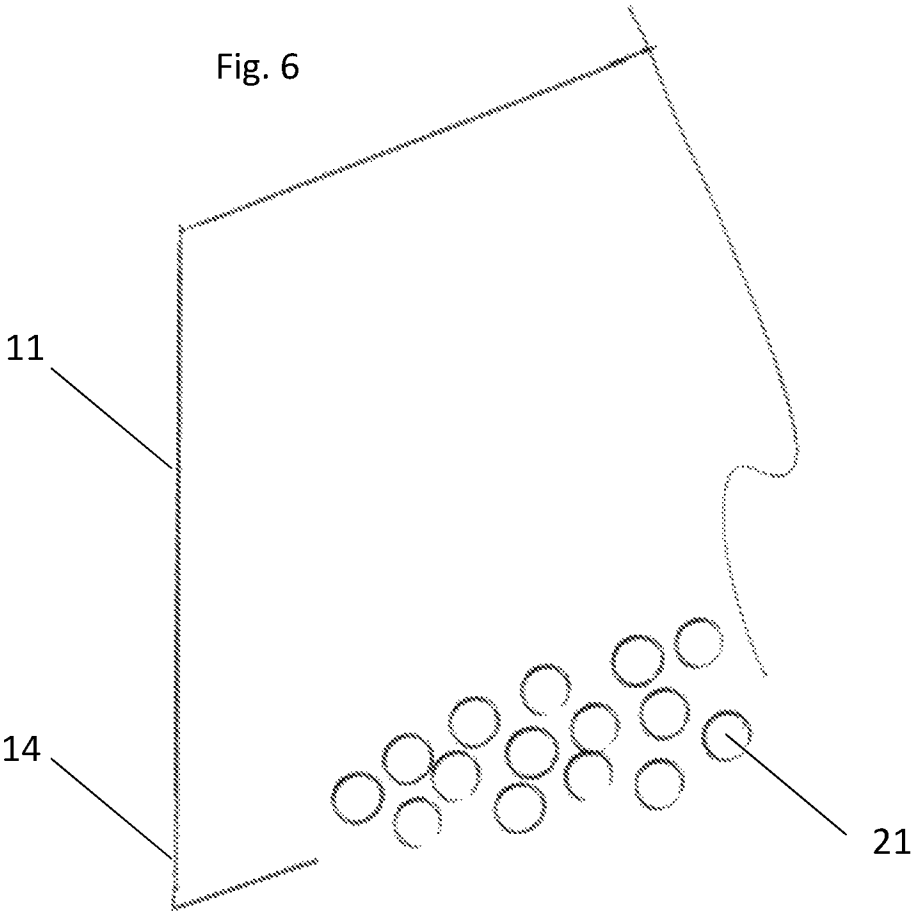
FIG. 6 is a raised front cut away perspective of the smooth blade being used to scoop up lose gravel and move it.

When using the serrated teeth blade on a gravel roof, the serrated blade is moved to the down position and the teeth 34 penetrate to between the gravel particles 20 adhering to the roof, as is show in FIG. 5. As the blade is moved forward by the tractor, the gravel is dislodged from the roof and becomes loose gravel 21. Typically this requires multiple passes over the gravel, from about two to three passes by the tractor to dislodge all the gravel 20. After that, the serrated blade is moved to the up position and the tractor then moves the smooth blade, as shown in FIG. 6 to scrape the loose gravel 21 clean to be removed from the roof.

Figure 7:
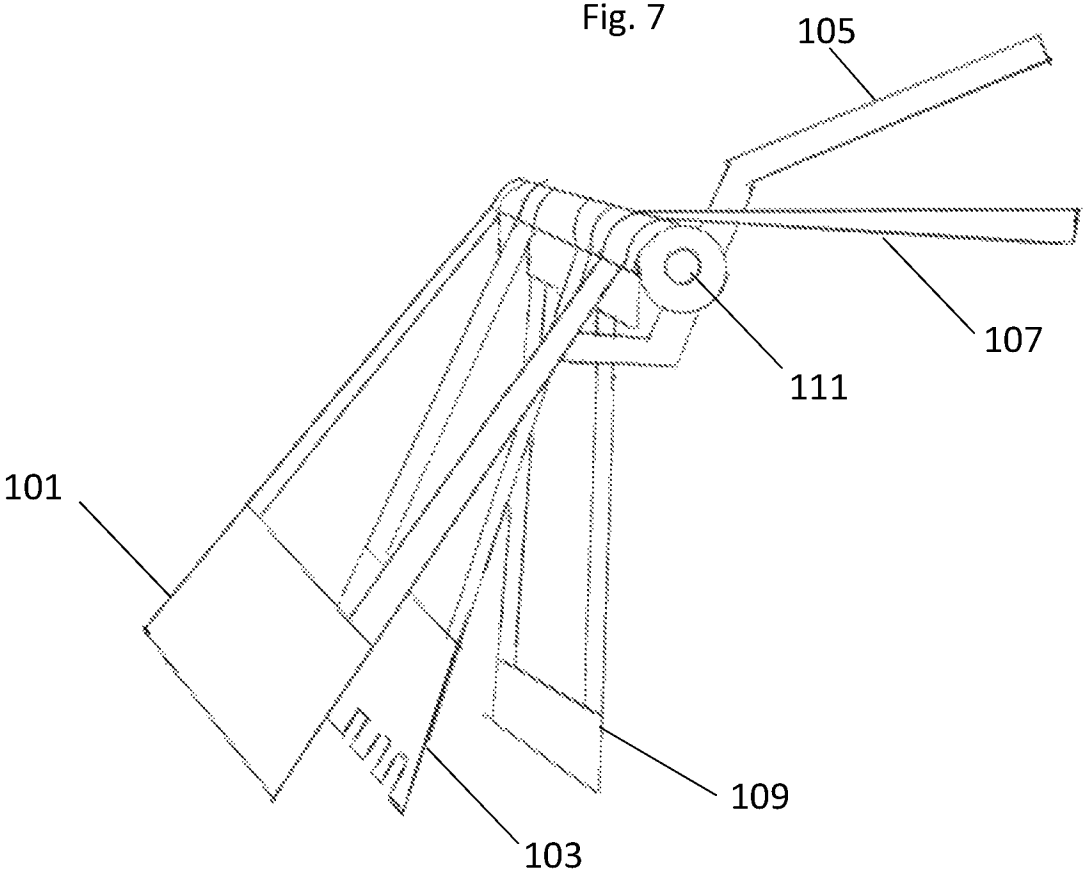
FIG. 7 is a side perspective of an embodiment of the blade assembly.
Figure 8:
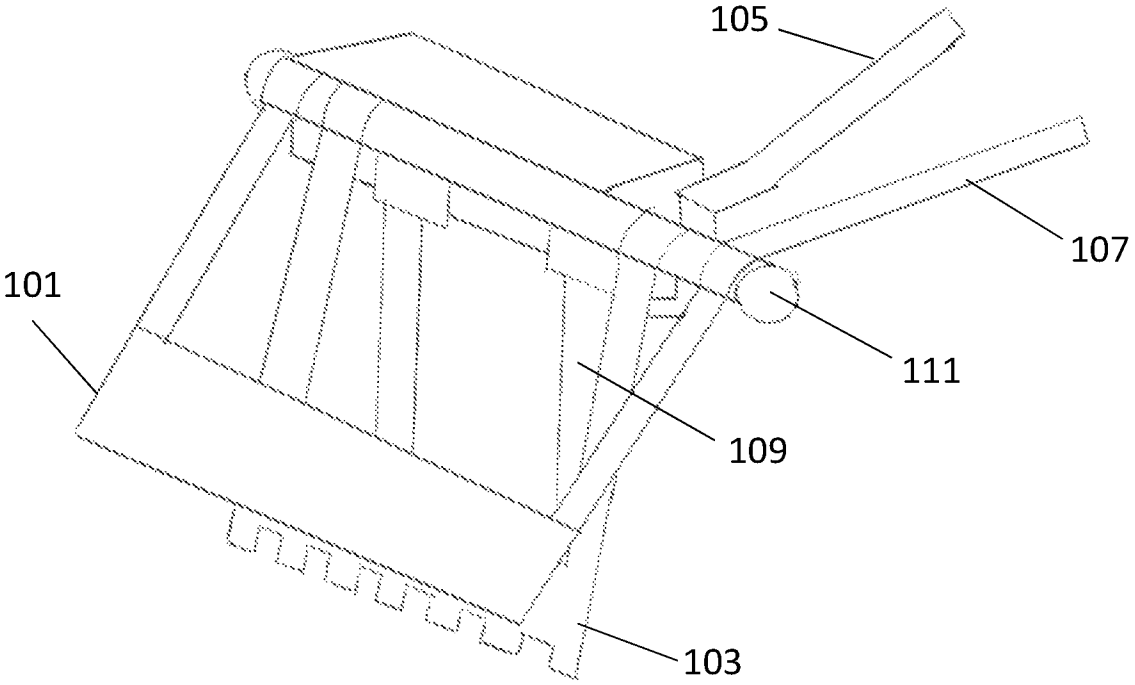
FIG. 8 is a raised side perspective an embodiment of the blade assembly.

FIGS. 7 and 8 are perspectives of a preferred embodiment of the blade assembly. The smooth blade 101 and the serrated blade 103 are moveably attached to pivot rod 111. In this embodiment, there is one pivot rod for both blades. Fixedly attached to pivot rod is backstop 109 which is located behind the blades, is approximately vertical, and extends about the length of the blades proximate the ground. Attached to the smooth blade 101 and beyond the pivot rod 111 is the smooth blade actuator lever 107. When the lever is actuated, the smooth blade pivots around the pivot rod 111 and moves to the up position. When the lever is returned to the unactuated position, the smooth blade pivots back to the down position. Likewise, attached to the serrated blade 103 is a serrated blade actuator lever 105, which acts to move the serrated blade from the down position to the up position and back. When either blade is in the down position, the backstop 109 reinforces and holds the blade in the desired vertical position. Preferably the pivot rod 111 is anchored to the frame of a drive mechanism such as a tractor, which provides a downward force.

Prior art devices have used serrations, sharp and tooth-like to scrape roofs to remove shingles. These devices are used horizontally, lying on the roof, to catch shingles or nails. When these devices are used on gravel, they merely pass over the gravel and do not loosen it. Devices that do not have the required dimensions of the serrations of the present invention merely pass over the gravel and do not loosen it. It is only by the claimed combination of a vertically mounted blade assembly having a serrated blade with novel serration dimensions, a forward force, and a downward force that the gravel is effectively scraped off and removed. When the serrated blade is applied to the roof to remove the gravel, it is approximately perpendicular to the roof.

The embodiments were chosen and described to best explain the principles of the invention and its practical application to persons who are skilled in the art. As various modifications could be made to the exemplary embodiments, as described above with reference to the corresponding illustrations, without departing from the scope of the invention, it is intended that all matter contained in the foregoing description and shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A device to remove gravel from a roof comprising:

a drive mechanism; and a blade assembly vertically attached to the drive mechanism;

wherein the blade assembly comprises a serrated blade with horizontal serrations;

wherein at least one downward force is applied to the serrated blade;

wherein the blade assembly further has a smooth blade with a horizontal edge; and wherein the blade assembly has a mechanism to move the smooth blade and/or the serrated blade from a down vertical position to an up position and back;

wherein the blade assembly uses two pivot points, one for the smooth blade and one for the serrated blade; and wherein the blade assembly uses a pivot rod to pivot both the smooth blade and the serrated blade.

2. The device of claim 1, wherein the drive mechanism is a riding drive mechanism.

3. The device of claim 2, wherein the serrated blade comprises teeth having a depth, a width, and a gap width;

wherein the teeth have a squared shape; and wherein the teeth have a flat edge.

4. The device of claim 3, wherein the tooth width is from about 1.0 to 1.5 inches;

wherein the gap width is from about 1.0 to 1.5 inches; and wherein, the depth is from about 1.1 to 0.875 inches.

5. A device to remove gravel from a roof comprising:

a riding drive mechanism; and a blade assembly vertically attached to the riding drive mechanism;

wherein the blade assembly comprises a smooth blade having a lower horizontal edge and a serrated blade having a serrated edge;

wherein the serrated blade is mounted proximate and parallel to the smooth blade;

wherein the smooth blade and/or the serrated blade has an up position and a down vertical position;

wherein the blade assembly has a mechanism to move the smooth blade and/or the serrated blade from a down vertical position to an up position and back;

wherein the blade assembly uses two pivot points, one for the smooth blade and one for the serrated blade;

wherein when the serrated blade is in the down vertical position, the serrations extend below the lower edge of the smooth blade and in the up position, the serrations are above the lower edge of the smooth blade; and wherein the smooth blade and/or the serrated blade is mounted on the riding drive mechanism to provide at least one downward force.

6. The device of claim 5, wherein the serrated blade comprises teeth having a depth, a width, and a gap width;

wherein the teeth have a squared shape; and wherein the teeth have a flat edge.

7. The device of claim 6, wherein the tooth width is from about 1.0 to 1.5 inches;

wherein the gap width is from about 1.0 to 1.5 inches; and wherein, the depth is from about 1.1 to 0.875 inches.

8. A device to remove gravel from a roof comprising:

a riding drive mechanism having a frame; and a blade assembly vertically attached to the riding drive mechanism;

wherein the blade assembly comprises a smooth blade with a horizontal edge and a serrated blade with a horizontal edge with serrations;

wherein the blade assembly has a mechanism to move the smooth blade and/or the serrated blade from a down vertical position to an up position and back;

wherein the blade assembly uses a pivot rod to pivot both the smooth blade and the serrated blade;

wherein the horizontal serrated blade is mounted proximate and parallel to the smooth blade;

wherein the smooth blade and/or the serrated blade has an up position and a down vertical position; and wherein the blade assembly is mounted on the frame of the riding drive mechanism that provides a downward force.

9. The device of claim 8, wherein the serrated blade comprises teeth having a depth, a width, and a gap width;

wherein the teeth have a squared shape; and wherein the teeth have a flat edge.

10. The device of claim 9, wherein the tooth width is from about 1.0 to 1.5 inches;

wherein the gap width is from about 1.0 to 1.5 inches; and wherein, the depth is from about 1.1 to 0.875 inches.

11. The device of claim 10, wherein the smooth blade and the serrated blade are moved from the down vertical position to the up position by actuator levers.

12. The device of claim 11, wherein the serrated blade is made from steel from about ¼ to about 1 inch thick.

13. The device of claim 12, wherein the steel comprises 6150 tooled steel.

* * * * *